US005303660A

United States Patent [19]

Lauersdorf

[11] Patent Number: 5,303,660

[45] Date of Patent: Apr. 19, 1994

[54] INDUSTRIAL OVEN WITH EXPANDABLE SURFACES

[75] Inventor: Duane H. Lauersdorf, Watertown, Wis.

[73] Assignee: Wisconsin Oven Corporation, East Troy, Wis.

[21] Appl. No.: 107,242

[22] Filed: Aug. 16, 1993

Related U.S. Application Data

[62] Division of Ser. No. 981,847, Nov. 25, 1992, Pat. No. 5,259,758.

[51] Int. Cl.[5] ..... F27D 1/00

[52] U.S. Cl. ..... 110/336; 52/267

[58] Field of Search ..... 432/248, 250–252; 110/336, 338, 339; 52/249, 267, 410, 573

[56] References Cited

U.S. PATENT DOCUMENTS

| | | | |
|---|---|---|---|
| 1,376,440 | 5/1921 | Ives | 266/285 |
| 1,807,868 | 6/1931 | Nygaard | 432/251 |
| 1,896,669 | 2/1933 | Frisch et al. | 432/251 |
| 3,091,817 | 6/1963 | Dosker | 20/4 |
| 3,301,546 | 1/1967 | Hansen et al. | 266/285 |
| 3,353,804 | 11/1967 | Suydam | 432/251 |
| 3,363,889 | 1/1968 | Shirley et al. | 52/410 |
| 3,366,375 | 1/1968 | Jones | 432/251 |
| 3,523,395 | 8/1970 | Rutter et al. | 52/410 |
| 3,881,288 | 5/1975 | Fay | 52/224 |
| 3,965,630 | 6/1976 | Roberts | 52/224 |
| 3,979,866 | 9/1976 | Prescott | 52/249 |
| 4,157,001 | 6/1979 | Pickles | 110/336 |
| 4,311,460 | 1/1982 | Lauersdorf et al. | 432/247 |
| 4,432,289 | 2/1984 | Norman et al. | 110/336 |
| 4,675,223 | 6/1987 | Trummer | 428/53 |
| 4,764,108 | 8/1988 | Carthew et al. | 432/251 X |
| 4,842,465 | 6/1989 | Pease et al. | 52/410 X |
| 4,959,012 | 9/1990 | Perfetti | 110/336 X |
| 5,063,861 | 11/1991 | Imogawa et al. | 110/336 |

*Primary Examiner*—William E. Tapolcai
*Attorney, Agent, or Firm*—Nilles & Nilles

[57] ABSTRACT

An industrial oven has at least one insulated wall including an inner shell connected to an outer shell by a plurality of pins extending through oversized holes in sheet metal plates forming the inner shell. The metal plates are simple metal sheets which can be easily sheared to size. The pins can compensate for significant misalignment between the inner and outer shells and do not require any modification of the insulation layers prior to mounting on the pins.

6 Claims, 12 Drawing Sheets

INDUSTRIAL OVEN WITH EXPANDABLE SURFACES

CROSS-REFERENCE TO RELATED APPLICATION

The present application is a divisional of U.S. patent application Ser. No. 07/981,847, filed Nov. 25, 1992, now U.S. Pat. No. 5,259,758.

BACKGROUND OF THE INVENTION

Field of the Invention

The present invention relates to industrial ovens and, more particularly, relates to large industrial ovens that are designed to accommodate temperature changes within the ovens and temperature differentials between inner and outer surfaces of the ovens.

Description of the Related Art

Industrial ovens are well known in the art and typically include a heated chamber enclosed by walls each comprising an outer metal shell, an inner metal shell disposed in spaced relation to the outer metal shell, and one or more layers of insulation provided between the outer and inner shells. These ovens are typically heated to temperatures of 1000° F. or more and are very large—on the order of 30 to 100 feet long by 12 feet wide by 10 feet high. Accordingly, the inner metal shells of such ovens undergo marked expansion when the internal chambers are heated. Such expansion could damage or even destroy the inner shell unless measures are taken to accommodate the expansion.

The inner shell of the typical industrial oven is composed of vertically extending plates of a tongue and groove construction permitting limited horizontal expansion of the plates towards one another. This typical construction is relatively expensive and difficult to assemble because special edge and corner pieces must be supplied by the manufacturer on site to achieve the required tongue and groove connection on edge and corner plates. Such a construction can also permit only limited expansion in the horizontal direction and permits little if any expansion in the vertical direction.

The typical industrial oven also inadequately compensates for temperature differentials between the inner and outer shells. Accordingly, devices connecting the inner and outer shells, such as plates in doors and doorways or the like, may undergo undesirable twisting or warpage at high temperatures. Industrial ovens typically do not adequately prevent such warpage and also do not adequately compensate for expansion of the internal air distribution systems of the ovens or for expansion of the floor.

Proposals have been made to alleviate at least some of the problems associated with typical industrial ovens. For instance, U.S. Pat. No. 3,363,889, which issued to Shirley et al on Jan. 16, 1968, proposes that the inner shell of an oven be constructed from a plurality of metal plates spaced from one another along both their vertical and horizontal edges. The plates are secured to the outer shell by keepers which are provided in the spaces between the plates and which apply tension to lapping strips covering the spaces. Spacings are provided between the keeper portions and the adjacent wall plates for expansion of the plates.

Although the system proposed by Shirley et al arguably permits vertical expansion of the plates, it exhibits several disadvantages.

First, the keepers holding the plates in position are relatively complex in construction and are difficult to assemble. In fact, to assemble a keeper, relatively large spaces must be provided between the outer layers of block insulation to permit passage of the keeper. These holes must be carefully aligned with the keepers to permit assembly of the oven. Insulation must be provided in the keepers to replace at least some of the insulation removed during formation of the holes in the outer layer of insulation. A heat barrier must also be provided between the inner and outer layers of insulation to help compensate for the insulation effect lost when holes are cut in the outer layer.

In addition, because the plates are held in place only by keepers provided at the edges of the plates, diagonal breaks must be formed on the inner faces of the plates to stiffen the plates. Since the breaks are typically formed in the plates by the manufacturer, the plates cannot easily be sized to fit on site. The plates also are bent to form upper and lower flanges which encase the outer layer of block insulation. Accordingly, special plates must be constructed by the manufacturer for edge and corner pieces, or complex bending operations must be performed on site. This significantly increases assembly time and expense and greatly decreases versatility of design.

Shirley et al also fails to address the problems of warpage of elements exposed to both hot and cold environments or the problem of expansion and contraction of the internal air distribution systems or floor.

OBJECTS AND SUMMARY OF THE INVENTION

It is therefore an object of the invention to provide an inner shell for a large industrial oven which is easy to assemble but which can adequately compensate for both vertical and horizontal expansion of the shell.

It is another object of the invention to provide an insulated wall for an industrial oven which is versatile because it does not require any cutting or forming of the insulation prior to assembly and which can compensate for substantial misalignments between the inner and outer shells of the wall.

In accordance with these objects of the invention, a wall for an oven includes an outer shell, a layer of insulation disposed between the outer shell and the chamber, and an inner shell including a plurality of generally planar metal plates disposed between the insulation layer and the chamber. Spaces are formed between all adjacent plates which permit expansion of the plates without mutual contact when the chamber is heated. Each of the plates has a plurality of oversized holes formed therein. A plurality of support pins are also provided, each of which includes a first end affixed to the outer shell, an elongated shank, a second end, and a head secured to the second end. The elongated shanks extend through the insulation layer and the holes and have diameters which are significantly smaller than those of the holes so as to permit movement of the plates relative to the pins upon expansion of the plates, the heads tensioning the plates towards the insulation layer, thereby holding the plates in position.

Advantageously a plurality of overlapping metal lapping strips are also provided, each of which covers at least a portion of one of the spaces and has a plurality of oversized holes formed therein. A second plurality of support pins are also provided in this case, each of which includes a first end affixed to the outer shell, an elongated shank, a second end, and a head attached to the second end. The elongated shanks extend through the insulation layer and the holes formed in the lapping strips and have diameters which are significantly smaller than those of the holes in the lapping strips so as to permit movement of the lapping strips relative to the pins upon expansion of the plates and the lapping strips, the heads tensioning the plates and the lapping strips towards the insulation layer, thereby holding the plates and the lapping strips in position.

Another object of the invention is to provide an industrial oven which can accommodate temperature differentials through the walls and floor of the oven.

In accordance with this aspect of the invention, an industrial oven is provided having a floor, a roof, and first and second walls connected to the floor and the roof and defining a heated chamber therebetween. Each of the first and second walls and the roof, as well as the door, is constructed as discussed above in connection with the first and second objects of the invention.

The floor preferably includes first and second metal floor plates spaced from one another to define a seam therebetween, and a plurality of connecting bars each of which extends across the seam beneath the first and second floor plates and has a first end secured to one of the floor plates and a second end in sliding contact with the other of the floor plates. Alternate connecting bars are secured to opposite ones of the first and second floor plates, thus permitting the floor plates to move or "walk" relative to one another without lifting. Preferably a generally central portion of each of the floor plates is secured to the underlying support to prevent the plates from shifting when objects are conveyed across the floor.

The door additionally includes a plurality of segmented plates provided at edges of the door and connecting the inner and outer shells, each of the segmented plates including a first end affixed to the outer shell and a second end which overlaps an edge of one of the door plates, the segmented plates being spaced from one another so as to permit expansion of the segmented plates without contact. The surrounding frame supports the door and includes a floating door header including (i) a header plate disposed in an enlarged opening formed in the frame to define a seam between the frame and the header plate, and (ii) a plurality of connecting bars. Each of the connecting bars extends across the seam and has a first end secured to one of the frame and the header plate and a second end in sliding contact with the other of the frame and the header plate. Alternate connecting bars are secured to opposite ones of the header plate and the frame, thus permitting the header to "walk" with respect to the surrounding frame.

Still another object of the invention is to provide an industrial oven having an internal air distribution system which is easy to install but which permits expansion of the air distribution system.

In accordance with this aspect of the invention, the air distribution system includes first and second hot air duct assemblies disposed adjacent respective walls of the oven, and a plurality of rods suspending the hot air distribution ducts from the roof. Each of first and second hot air duct assemblies has a hot air inlet formed in an upper portion thereof and a plurality of openings formed therein which face the chamber and which permit the passage of air out of the air distribution ducts and into the chamber. Preferably, the air distribution system further comprises a false ceiling which extends between the first and second hot air distribution duct assemblies, which is suspended from the roof, and which has a plurality of openings formed therein which permit the passage of air therethrough. By suspending the system from the roof in this manner, the air distribution system can expand without interference from the floor, roof, or walls of the oven.

Yet another object of the invention is to provide a method of simply and easily constructing a wall of an industrial oven.

In accordance with this aspect of the invention, the method comprises the steps of providing an outer shell exposed to one of an ambient and a near-ambient atmosphere, affixing a plurality of pins to an inner surface of the outer shell, and impaling a layer of insulation on the pins such that the layer of insulation is supported on the pins. Subsequent steps include aligning oversized holes, formed in a plurality of metal plates, with some of the pins such that inner surfaces of the plates face a chamber of the oven to be heated, and placing the plates over the pins such that the pins extend through the holes in the plates and such that spaces are formed between all adjacent plates which permit expansion of the plates without mutual contact when the chamber is heated. A final step includes attaching heads on the pins to secure the plates in position while permitting sliding of the plates with respect to the heads.

The inventive configuration permits the step of bending at least one of the pins prior to placing the palates over the pins, thus aligning a designated one of the holes with the at least one pin. This configuration also permits cutting some of the plates for placement on edges of the oven.

Yet another object of the invention is to provide a process of expanding the surfaces of an industrial oven upon heating.

In accordance with this aspect of the invention, the process includes heating an inner chamber of an oven, and expanding an inner shell of the oven under the heat by expanding each of a plurality of metal plates towards one another without mutual contact, with the expansion causing relative movement between the plates and a plurality of pins connecting the plates to an outer shell of the oven. To permit such expansion, each of the pins is connected to the outer shell and has (1) a shank extending through an oversized hole formed in a respective one of the plates, and (2) a head attached to the shank and applying tension to the respective one of the plates.

These and other objects, features, and advantages of the present invention will become apparent to those skilled in the art from the following detailed description and claims. It should be understood, however, that the detailed description and specific examples, while indicating preferred embodiments of the invention, are given by way of illustration and not of limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being made to the accompanying drawings in which like-reference numerals represent like-parts throughout, and in which.

DETAILED DESCRIPTION OF THE PREFERRED EMBODIMENT

Resume

Pursuant to the invention, an industrial oven is provided having insulated walls and insulated doors each including an inner shell connected to an outer shell by a plurality of pins extending through oversized holes in sheet metal plates forming the inner shell. The metal plates are simple metal sheets which can be easily sheared to size. The pins can compensate for significant misalignment between the inner and outer shells and do not require any modification of the insulation layers prior to mounting on the pins. Measures are also taken to permit expansion of the floor and air distribution system without requiring complex interconnections of the floor plates or of the air distribution system to the oven walls. Elements which are exposed to both hot and cold temperatures are designed so as not to warp or buckle under the temperature differentials between the inner and outer shells of each oven wall.

Overview of Oven Construction

Figure 1:
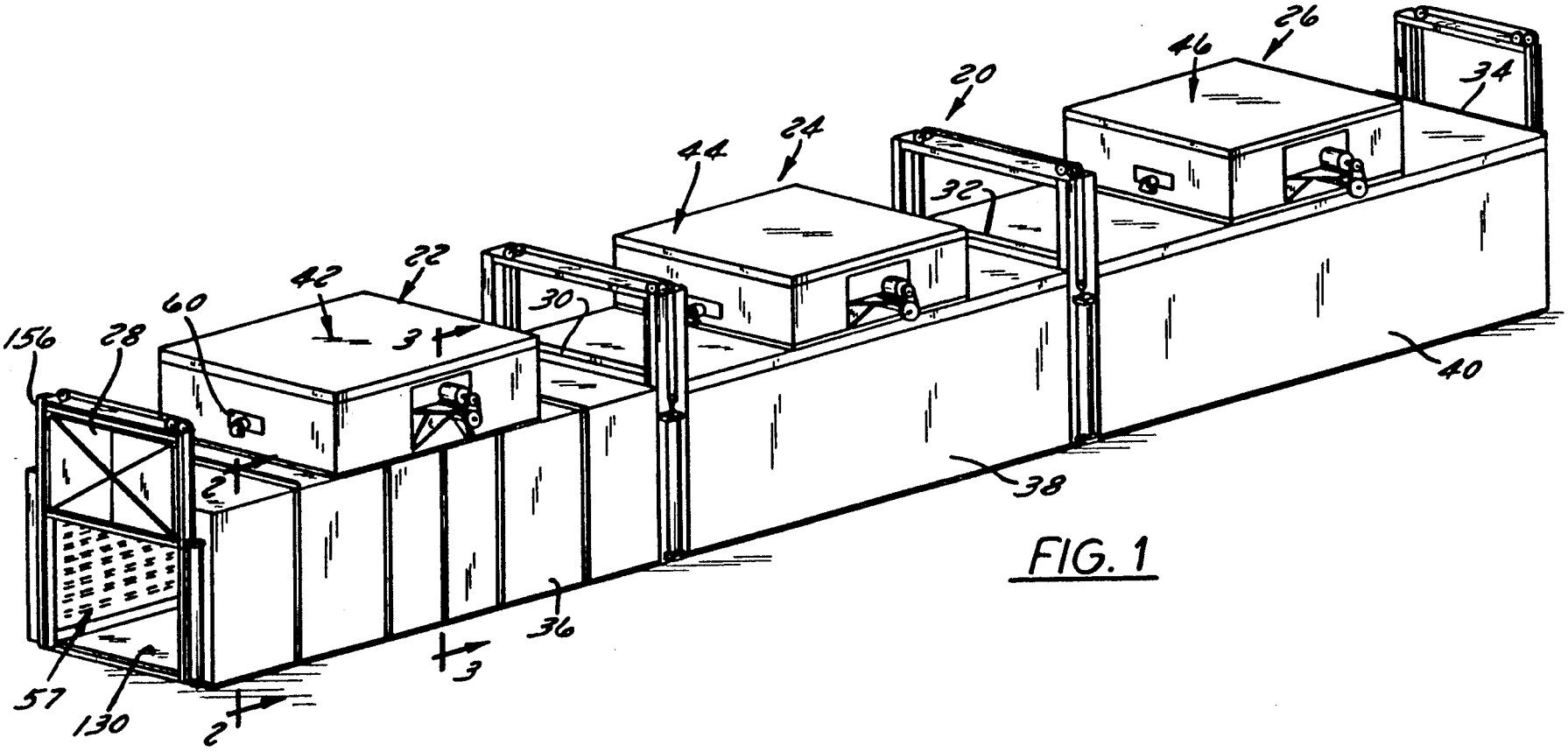
FIG. 1 is a perspective view of an industrial oven constructed in accordance with a preferred embodiment of the present invention.
Figure 2:
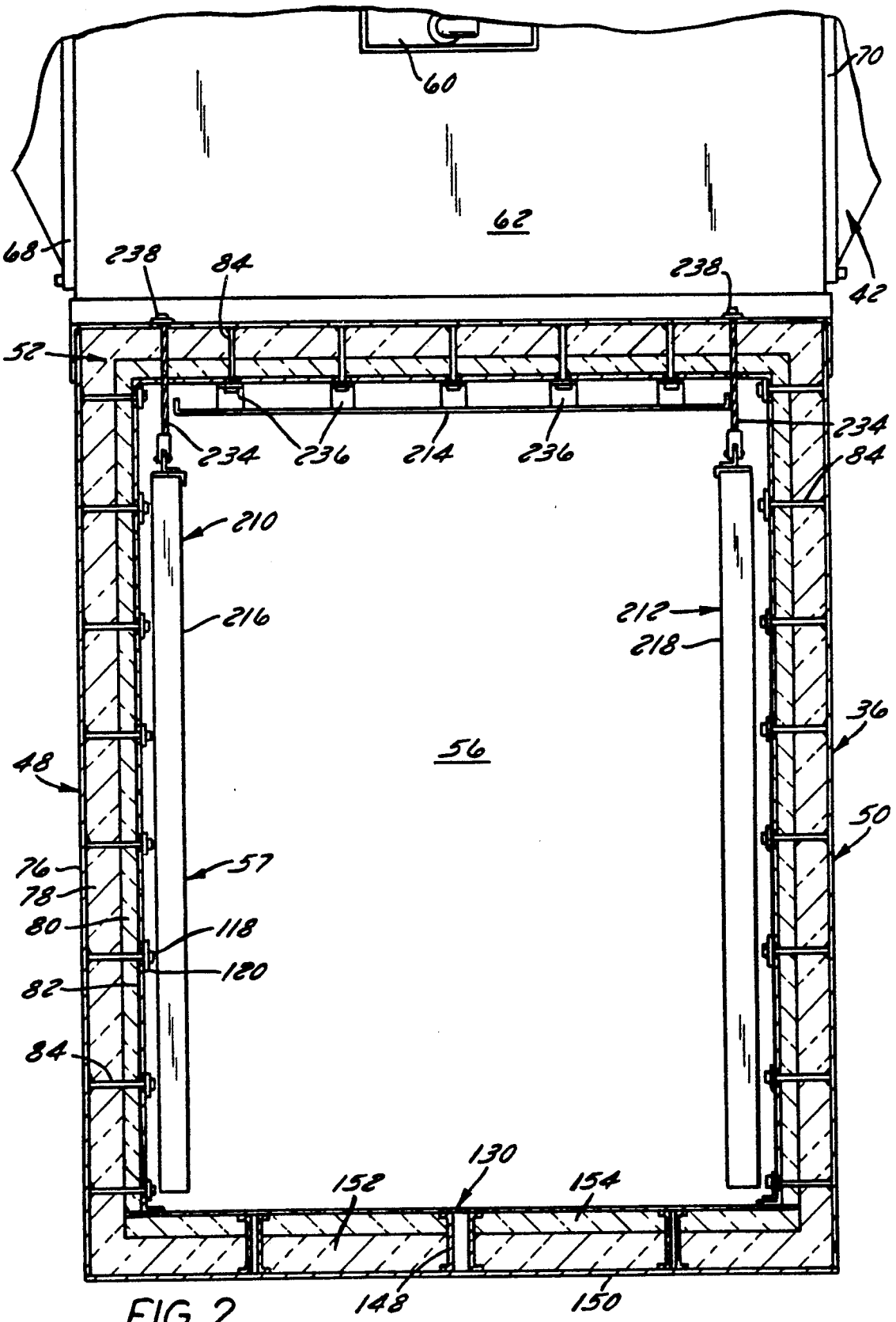
FIG. 2 is a sectional elevational end view taken along the lines 2—2 of FIG. 1.
Figure 3:
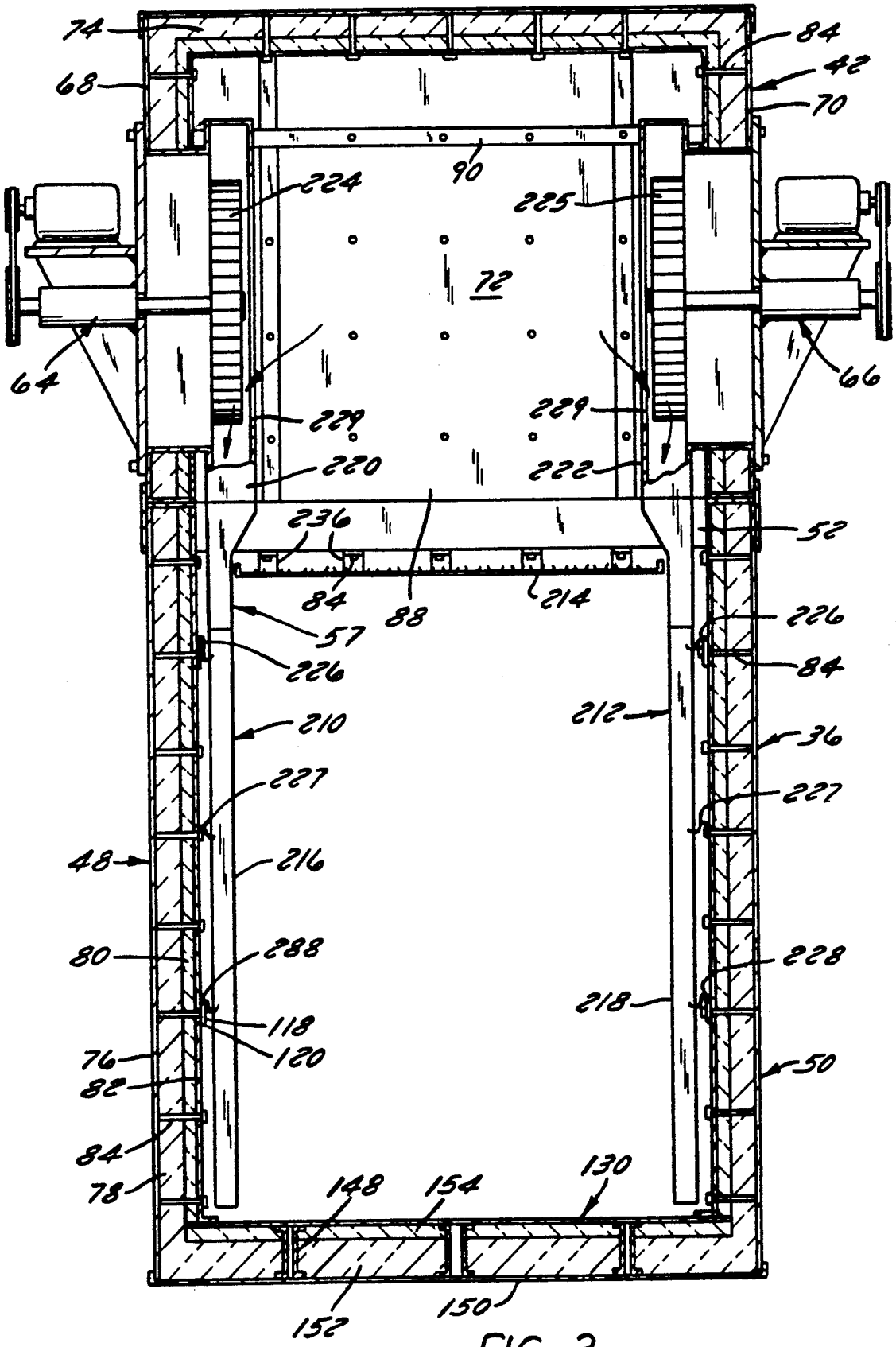
FIG. 3 is a sectional elevational end view taken along the lines 3—3 of FIG. 1.
Figure 4:
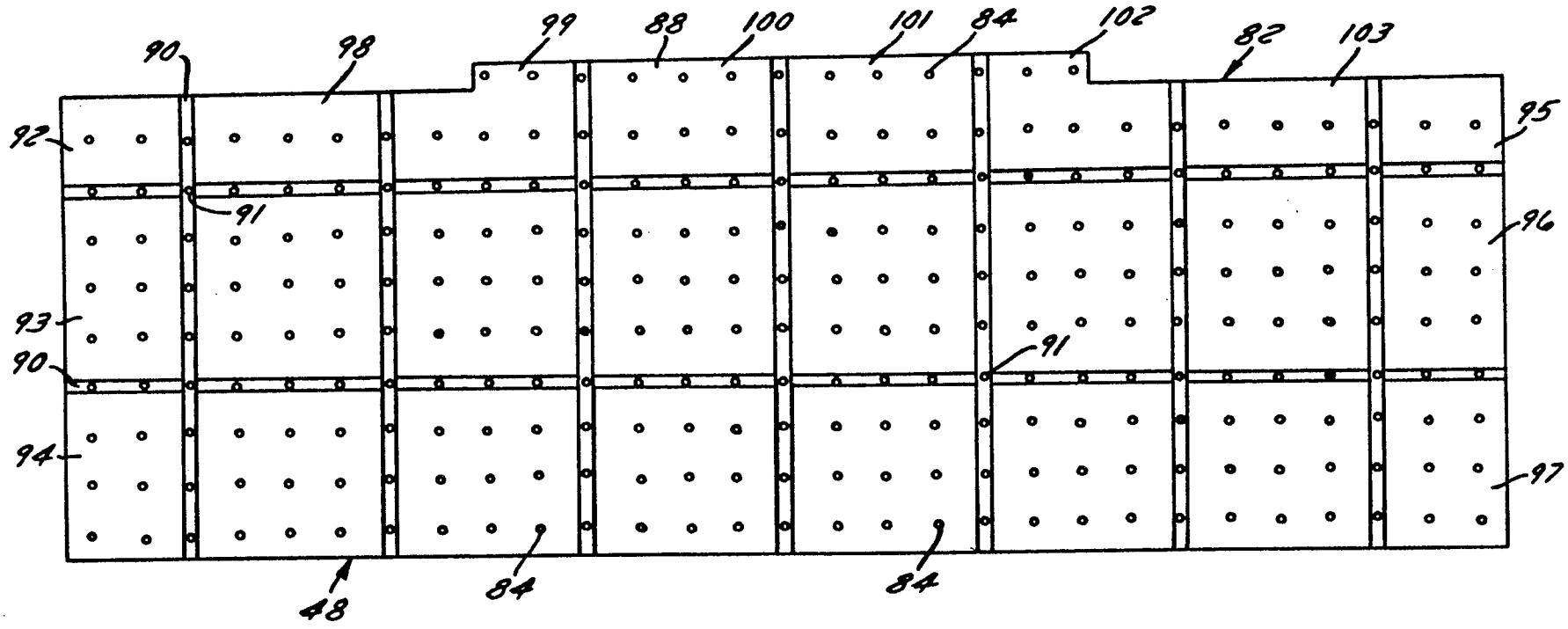
FIG. 4 is a side elevational view of the inner shell of one of the side walls of one section of the oven of FIG. 1.
Figure 5:
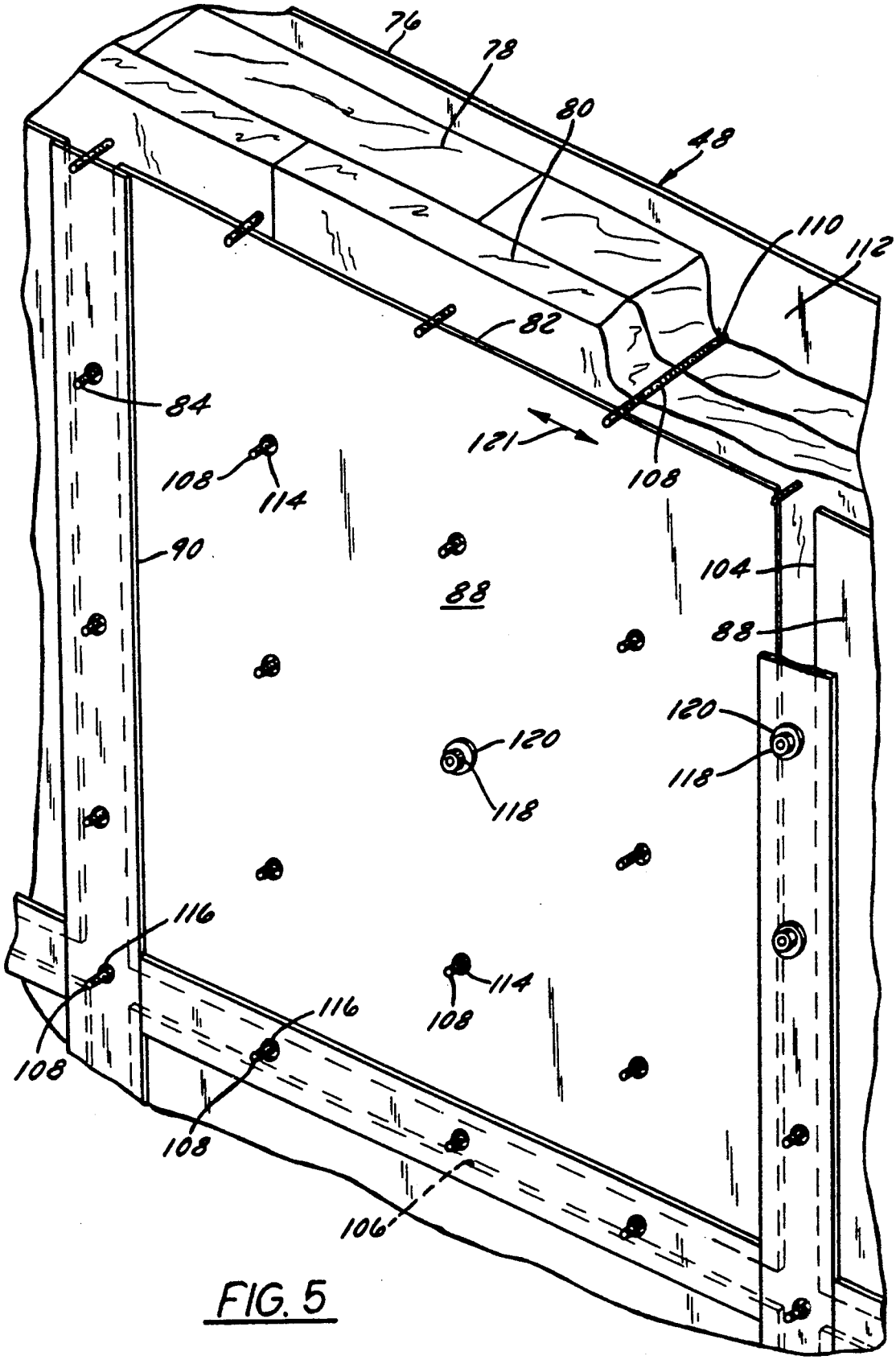
FIG. 5 is an enlarged perspective view, illustrated partially in cross section, of a portion of the inner shell illustrated in FIG. 4.
Figure 6:
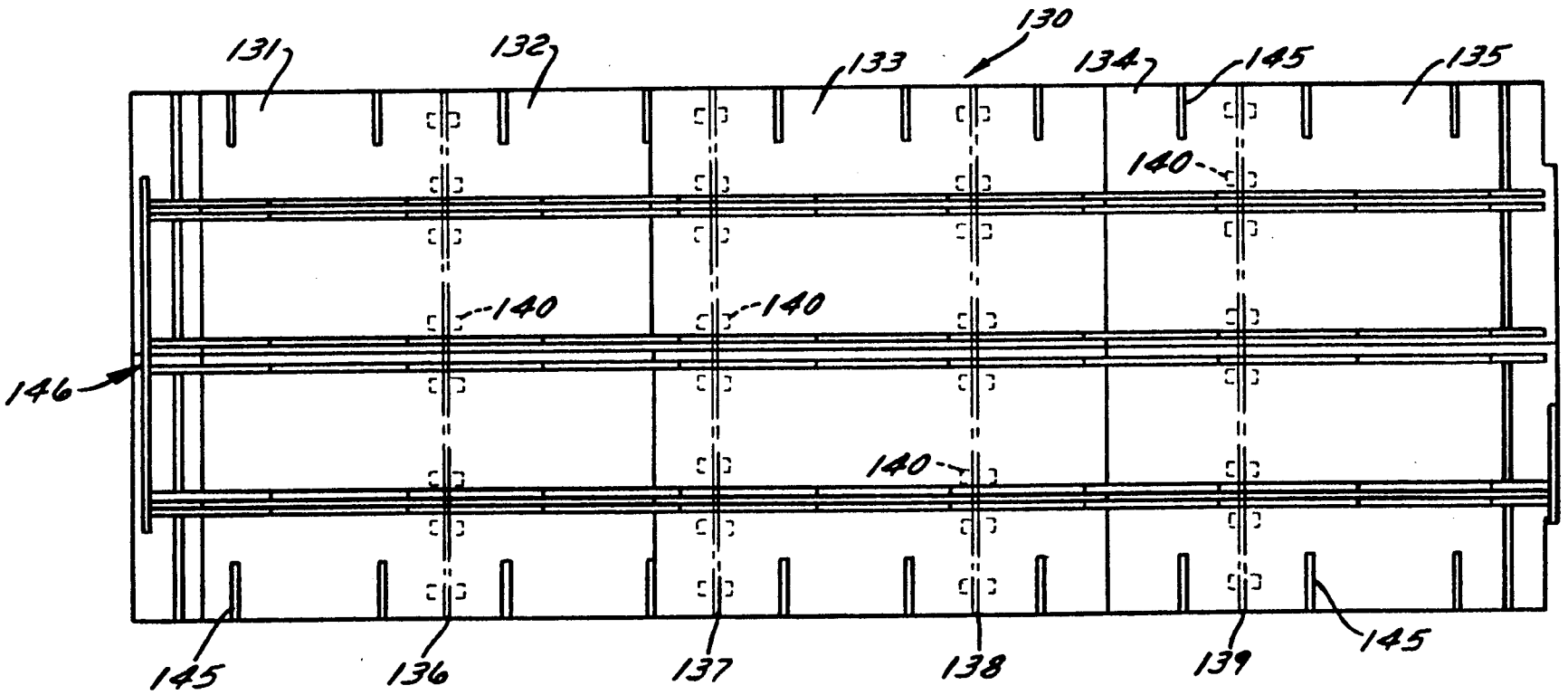
FIG. 6 is a plan view of the floor of one section of the oven of FIG. 1.

Referring now to the drawings, and particularly to FIG. 1, an industrial oven 20 constructed in accordance with the present invention includes first, second, and third heating zones 22, 24, and 26 which can be isolated from one another and from the ambient atmosphere by doors 28, 30, 32, and 34. The first, second, and third heating zones include respective oven sections 36, 38, and 40 having respective heater housings 42, 44, 46 mounted thereon. The illustrated oven is very large so as to heat relatively large equipment such as aircraft fuselage parts or aircraft wings. Each of the oven sections 36, 38, and 40 is approximately 33 feet long by 12 feet wide by 10 feet high. The internal chambers of the sections 36, 38, and 40 of the first, second, and third heating zones 22, 24, and 26 are heated individually and thus may be heated to three different temperatures. For example, the temperature in the first zone 22 could be 1400° F., the temperature in the second zone 24 could be 250° F., and the temperature in the third zone 26 could be 500° F. The provision of separately heated zones thus permits sequential heating of devices in the same oven in an assembly line fashion. Of course, the internal chamber of each zone could be of virtually any size and shape. In addition, a single-zone oven could be employed if multiple heating operations are not desired.

Pursuant to the invention, one or all of the sections 36, 38, and 40 of oven 20 are designed to accommodate expansion of the internal elements of the respective oven sections and to accommodate temperature differentials across the walls of the oven sections. Similar accommodation measures are taken in each of the heater housings 42, 44, and 46. If all three heating zones 22, 24, and 26 are to be designed to withstand relatively high temperatures, each will be of identical construction. Accordingly, the following description of heating zone 22 is equally applicable to zones 24 and 26.

Referring to FIGS. 2-7, the oven section 36 of heating zone 22 includes side walls 48 and 50, a roof or top wall 52, and a floor 130 which together define an enclosed heating chamber 56. An air distribution system 57 is disposed within chamber 56 and is connected to heater housing 42 so as to heat the air present in the chamber 56 and to circulate the heated air through the chamber 56. Heater housing 42 includes a gas fueled burner 60 mounted on a front wall 62 thereof, first and second fan assemblies 64 and 66 mounted on respective side walls 68 and 70 thereof, a rear wall 72, and a roof 74.

Construction of Walls

Each of the walls 48, 50, and 52 of the first oven section 36, and the walls 62, 68, 70, and 72 and the roof 74 of heater housing 42, is of identical construction and is designed to minimize heat transfer from the inner chamber 56 of the oven section 36 to the outside of the walls while permitting expansion of the inner surfaces of the walls and accommodating temperature differentials through the walls. Accordingly, only the left side wall 48 of the first oven section 36 will be described. Referring especially to FIGS. 2-5, wall 48 includes a relatively rigid outer shell 76, two layers of insulation 78 and 80, and an inner shell 82 connected to the outer shell 76 by a plurality of pins 84 in a manner described in more detail below.

Outer shell 76 is preferably formed from steel plates or some other material having sufficient rigidity to support the layers of insulation 78 and 80 and the inner shell 82 and to support the top wall 52 and the heater housing 42. Reinforcing elements 86 (FIG. 1) may be provided to strengthen the outer shell 76 if desired. Since the outer shell 76 is in contact with an ambient or near ambient atmosphere and thus is seldom if ever exposed to temperatures of more than 130° F., little or no provision need be made to compensate for expansion.

Insulation layers 78 and 80 are provided to minimize heat transfer from the chamber 56 to the outer shell 76. Two layers are provided in the illustrated embodiment because the chamber 56 is designed to be heated to temperatures of 1400° F. or more. The inner layer 80 is formed from block-type insulation capable of withstanding temperatures of 1900° F. or more. This relatively thin layer of insulation reduces the amount of heat transferred therethrough to permit the remainder of the space between the inner and outer shells 82 and 76 to be filled by a relatively thick layer of more conventional batt insulation capable of withstanding temperatures of 1000° F. Of course, different combinations of insulation could be provided if desired or if conditions required.

Inner shell 82 comprises a plurality of relatively thin metal plates 88 and a plurality of lapping strips 90 which cover spaces formed between adjacent plates and which overlap one another at junctions 91. The plates 88 are constructed from stock sheets or panels. Although virtually any sized sheets could be used for the plates 88, four foot by four foot sheets are preferred because they minimize the number of plates while still maintaining the expansion per plate within acceptable limits. These sheets may be relatively thin and need no breaks or other reinforcing devices because they are held in place by the pins 84 in a manner discussed in more detail below and thus can be easily sheared or cut on site to fit a particular location. Thus, in the illustrated embodiment, side plates 92–97 and top plates 98–103 have been cut to fit the edges of the wall 48 of oven section 36. This greatly simplifies assembly and reduces costs because specially dimensioned plates need not be kept on hand when constructing an oven. This is particularly true in the case of plates 99 and 102 which are stepped to accommodate the shape of the junction of the heater housing 42 and the oven section 36. Providing breaks or other reinforcements in such stepped plates may require that they be custom made for a particular application, thus rendering them very expensive and difficult to install. This expense is avoided by the present invention.

Adjacent plates 88 are spaced from one another by as much as 1½ inches so as to permit expansion of the plates upon heating of chamber 56 without mutual contact. These spaces include both vertical spaces 104 and horizontal spaces 106 which permit expansion of the plates 88 both vertically and horizontally. Lapping strips 90 perform two functions. First, they cover spaces 104 and 106, thereby increasing the aesthetics of the wall and also preventing insulation from being exposed to the chamber 56. Second, they help hold the plates 88 in position under the force of pins 84 as discussed in more detail below. Lapping strips 90 could be unwound from rolls and cut to any desired length. Alternately, strips of a few stock lengths of, e.g., 48", 45", and 27" could be supplied by the manufacturer and overlapped as needed.

The material used for the plates 88 and the lapping strips 90 may vary depending upon the expected temperatures inside the chamber 56 of the oven section 36. Typically, aluminized steel will be used if the temperature in the chamber 56 is not expected to exceed 1000° F., 304 stainless steel will be used if the temperature is expected to be between 1000° F. and 1250° F., and 309 stainless steel will be used if the temperature is expected to be between 1250° F. and 1400° F.

In the illustrated embodiment, each of the pins 84 includes a bendable threaded shank 108 having a first end 110 welded or otherwise affixed to the inner surface 112 of outer shell 76 (FIG. 5) and a second end extending through the first and second layers of insulation 78 and 80. The second end of the shank of each of a first plurality of these pins 84 extends through a corresponding oversized hole 114 formed in a respective one of the plates 88 of the inner shell 82. A second plurality of pins 84 have shanks 108 which extend through the spaces 104 and 106 formed between the plates 88 and through corresponding oversized holes 116 formed in the lapping strips 90. The holes 114 and 116 should be sufficiently large so as to permit maximum expansion of the plates 88 and lapping strips 90 without interference from the pins 84. In the illustrated embodiment, the shanks 108 of the pins 84 are about ¼" in diameter, and the holes are at least 1" in diameter.

The plates 88 and lapping strips 90 are tensioned against the insulation layer 80 and thus held in place by threaded heads 118 and washers 120 secured to the ends of the shanks 108 of pins 84.

Because the shanks 108 of the pins 84 are relatively small, special holes need not be formed through the insulation layers 78 and 80 for receiving the shanks. The layers of insulation can instead be impaled directly over the shanks. This not only greatly facilitates assembly of the oven, but also improves the ability of the pins 84 to support the insulation layers. This improved support prevents or at least inhibits sagging or settling which is often otherwise present in preassembled ovens after the inner shells are prestressed and the ovens shipped.

Impaling the insulation layers 78 and 80 on the pins 84 also minimizes the heat loss that would otherwise occur between the holes in the insulation layers and the pins 84. This minimization of heat loss in turn permits the use of a relatively high number of pins 84 to hold the lapping strips 80 and plates 88 in position, which in turn permits the use of thinner plates and lapping strips. In the illustrated embodiment, each four foot by four foot plate 88 is held in place by nine pins extending through the plate and sixteen pins engaging the lapping strips 90 covering the spaces 104 and 106 surrounding the plate. Of course, more or less pins could be provided in different arrangements, if desired.

The wall 48, as well as the remaining side, end, and top walls or roofs of the oven sections 36, 38, and 40 and of heater housings 42, 44, and 46, are constructed as follows. First, the frame is built from outer shell 76. Then, the shanks 108 of the pins 84 are welded or otherwise affixed to the inner surface 112 of the outer shell 76. The first and second layers 78 and 80 of insulation are then impaled over the pins 84 and pressed up against the inner surface 112 of outer shell 76. Then, the holes 114 of the plates 88 are inserted over a first plurality of the pins 84. The holes 116 in the lapping strips 90 are then inserted over the second plurality of pins 84 to cover the spaces 104 and 106 formed between the plates 88. If any of the holes 114 or 116 are misaligned for any reason, the shank 108 of the respective pin can be bent, e.g., in the direction of arrow 121 in FIG. 5, to provide the required alignment. Such an alignment would not be possible with devices having rigid pin or keeper elements.

Washers 120 and heads 118 are then attached to the pins 84, thus tensioning the plates and lapping strips in position. In the illustrated embodiment, the heads 118 are internally threaded and are attached to the shanks 108 of pins 84 simply by screwing them onto the external threads of the shanks. Any other suitable connection could also be used to attach the heads to the pins. Oversized heads 118 could also be used to eliminate the need for washers 120, if desired.

When the inner chamber 56 of the first section 36 of oven 20 is heated, the plates 88 expand towards one another without mutual contact, with the expansion causing relative movement between the plates 88 and the pins 84 permitted by oversized holes 114. Expansion of lapping strips 90 is likewise permitted by the play between the holes 116 in the lapping strips and the associated second plurality of pins 84.

Description of Floor

Each section 36, 38, and 40 of oven 20 also has a floor 130 specially designed to accommodate expansion of the metal plates of the floor by allowing the plates to float with respect to one another and, to a certain extent, to float with respect to the supports on which they are mounted. It is, however, preferred that measures be taken to prevent the plates from rocking or in any way moving vertically with respect to one another. Measures should also be taken to prevent the floor from shifting with respect to its supports when objects are conveyed across the floor.

Figure 7A:
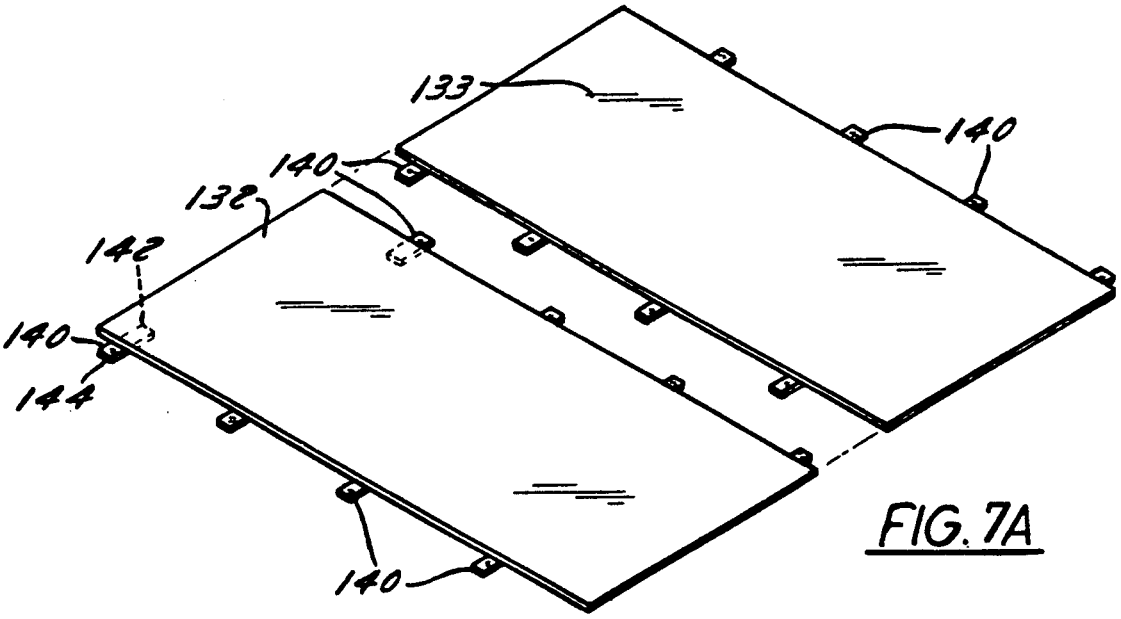
FIG. 7A is an exploded perspective view of two adjacent plates of the floor illustrated in FIGS. 6 and 7.
Figure 7:
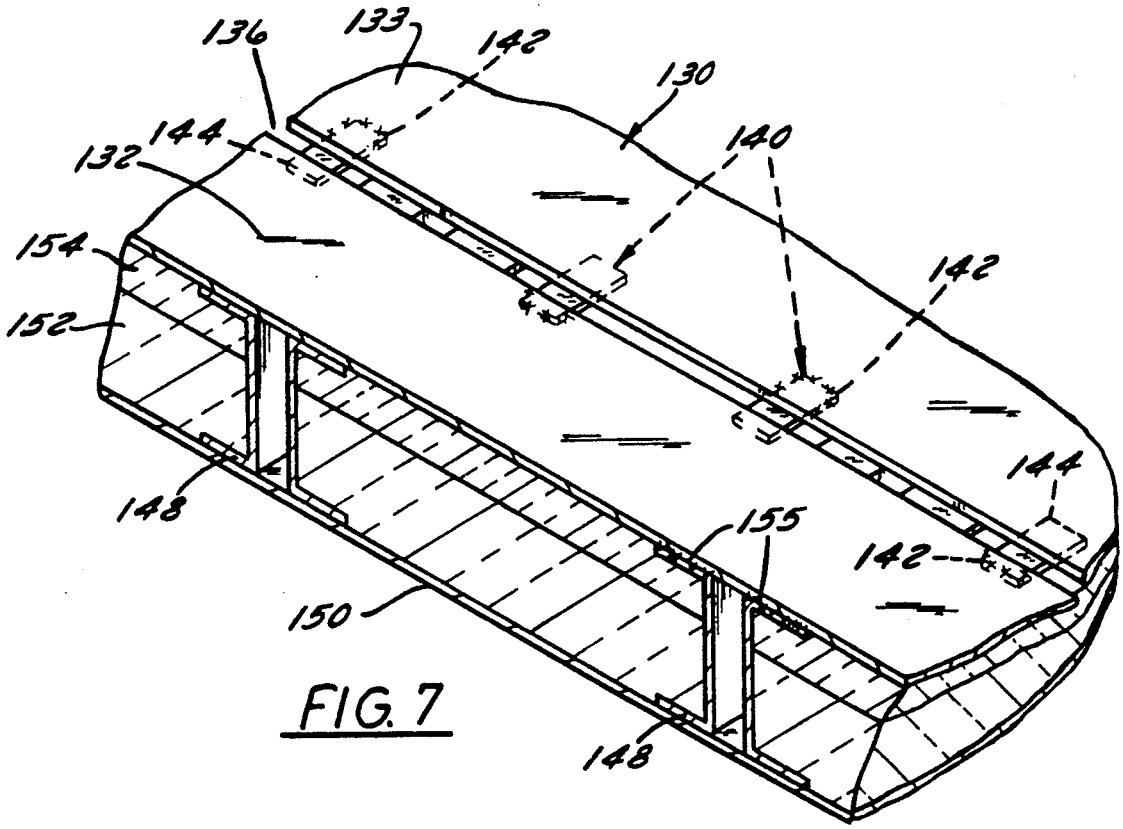
FIG. 7 is a perspective view of a portion of the floor illustrated in FIG. 6.

In the illustrated embodiment, the floor 130 comprises a plurality of plates 131–135 (FIGS. 6–8) disposed adjacent each other with seams 136–139 formed therebetween. The provision of multiple expandable sections enables the floor to grow in reduced increments. Thus, instead of attempting to compensate for the expansion of a single sheet of 33 or more feet long, the sheet is broken up into segmented plates which are each only a few feet long and which thus undergo much less expansion. These plates are interconnected to form a so-called "walking surface" by interconnecting the adjacent plates with connecting bars 140 which are positioned beneath the plates and which bridge the seams between the plates. Each connecting bar 140 has a first end 142 spot welded or otherwise affixed to one of the adjacent plates and a second end 144 which extends beneath the other of the adjacent plates but which is not in any way affixed to that plate. As is illustrated in FIGS. 7 and 7A, alternate connecting bars 140 are secured to opposite ones of first and second adjacent plates 132 and 133. These bars thus act as interlocked fingers which permit the plates 132 and 133 to slide or "walk" relative to one another but which prevent them from moving vertically with respect to one another.

The upper surfaces of the plates 131–135 have brackets 145 attached thereto for connection to the side walls of the oven 20. If desired, a track 146 can be provided on top of the floor 130 to convey articles to be heated through the oven section 36.

The bottom surface of the floor 130 is supported on a plurality of I-beams 148 or the like which are in turn supported on a support surface 150. I-beams 148 preferably do not extend the length of the oven, but instead are provided in relatively short segments having gaps formed therebetween permitting expansion of the I-beams upon heating of the oven. Two layers of insulation 152 and 154, corresponding to the layers 78 and 80 provided in the walls of the oven, are provided between the support surface 150 and the floor 130 to inhibit heat transfer from the floor to the support surface. To prevent the individual plates 131–135 of the floor from shifting under the weight of articles being conveyed across the floor, the central portion of each of these plates is preferably plug welded or otherwise secured to the underlying support 148 at one or two locations 155. Such a central connection does not interfere with normal expansion of the plates during operation of the oven.

Construction of Door Frame and Door

Each of the doors of oven 20 is similar in construction to that of the walls and ceiling of the oven and thus accommodates expansion of the inner shell of the door. The doorway for each door necessarily includes elements connecting the ambient or near ambient outside of the oven to the extremely hot inside chamber 56. Each doorway, as well as the header plate for the door and the edge of the door itself, is constructed so as to minimize the effects of this temperature differential on these elements. Each doorway and the associated door are essentially identical in construction to the other doors and doorways. Accordingly, only door 28 and the associated doorway 196 located at the front of the first oven section 36 will be described.

Referring to FIGS. 8–11, door 28 is slidably mounted in a mast assembly 156 secured to a front wall 158 of oven 20. In the illustrated embodiment, each side of the door 28 is mounted on upper and lower pins 160 and 161 received in respective tracks 162 and 163 of mast assembly 156 and is raised and lowered by a chain 164 driven by a piston and cylinder arrangement 166 in a manner which is, per se, well known.

The door 28 is formed from a panel having an outer shell 168 reinforced with diagonal struts 170 and peripheral struts 171, an inner shell 172, first and second layers of insulation 174 and 176, and a side frame 178.

The first and second layers of insulation 174 and 176 are identical to those provided in the walls and underneath the floor of the oven and thus will not be described in greater detail. Similarly, the inner shell 172 includes a plurality of plates 180 and a plurality of overlapping strips 182 anchored to the outer shell 168 by a plurality of pins 184 received in oversized holes 186 thereof, and thus is identical in construction to the inner shell of the walls of the oven and, accordingly, will not be discussed in greater detail.

The side frame 178 is composed of a plurality of L-shaped segmented plates 188 each having first and second legs 190, 192. The first leg 190 of each of the plates 188 is welded or otherwise affixed at its terminal end 193 to an inner surface of outer shell 168. The second leg 192 overlaps an edge 195 one of plates 180 of the inner shell and is secured to the plate 180 by pins 184. The plates 188 are segmented, i.e., spaced from one another by a relatively narrow gap of, e.g., one-quarter inch, to permit expansion of the plates relative to one another without buckling.

The door 28 in its closed position seals against a gasket 197 which is attached to frame 194 and which surrounds an opening forming the doorway 196. The tracks 162 and 163 for the door 28 are mounted on support posts 198 which form part of the mast assembly 156 and which are attached to the frame 194. Each of the tracks 162 and 163 is angled inward towards the frame 194 at a lower end 200, 202 thereof. These angled portions guide the door 28 to slide inwardly as it closes, thus sealing the door tightly against gasket 197.

Figure 8:
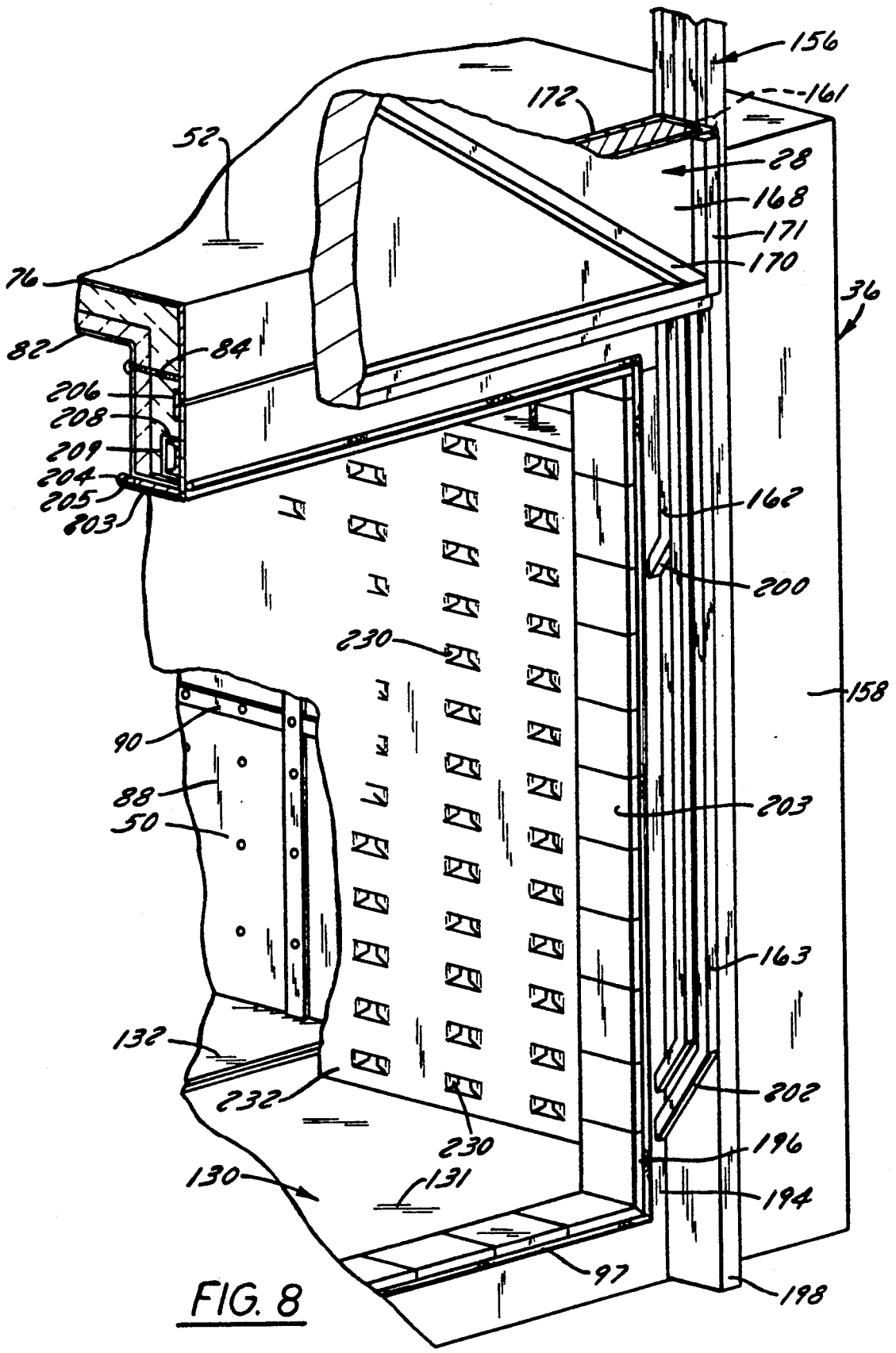
FIG. 8 is a perspective view of an end the oven of FIG. 1, viewed from outside the oven.

The periphery of doorway 196, like the side frame of door 28, has opposed surfaces exposed to vastly different temperatures. Accordingly, the periphery of doorway 196 is formed from a plurality of segmented plates 203 extending through the width of the doorway. These plates perform a function similar to those of plates 188 discussed above and are anchored to the outside of doorway 196 and are more loosely connected to the inner shell of the oven. They may be identical in construction to the plates 188 or, alternatively, may be generally J-shaped as illustrated in FIG. 8, with the inner ends 204 being bent outwardly so as to receive flanges 205 formed in respective plates of the inner shell 82. This construction prevents the inner shell from bending inwardly but at the same time permits significant expansion of the inner shell relative to the segmented plates because there is no direct coupling of the segmented plates to the inner shell. The individual plates 203 are also spaced from one another to permit expansion of the plates towards one another. These plates thus accommodate expansion due to the high internal temperatures of the oven and also for temperature differentials across the cross section of the oven. All other surfaces forming the periphery of openings in the oven are formed from similar segmented plates.

Figure 9:
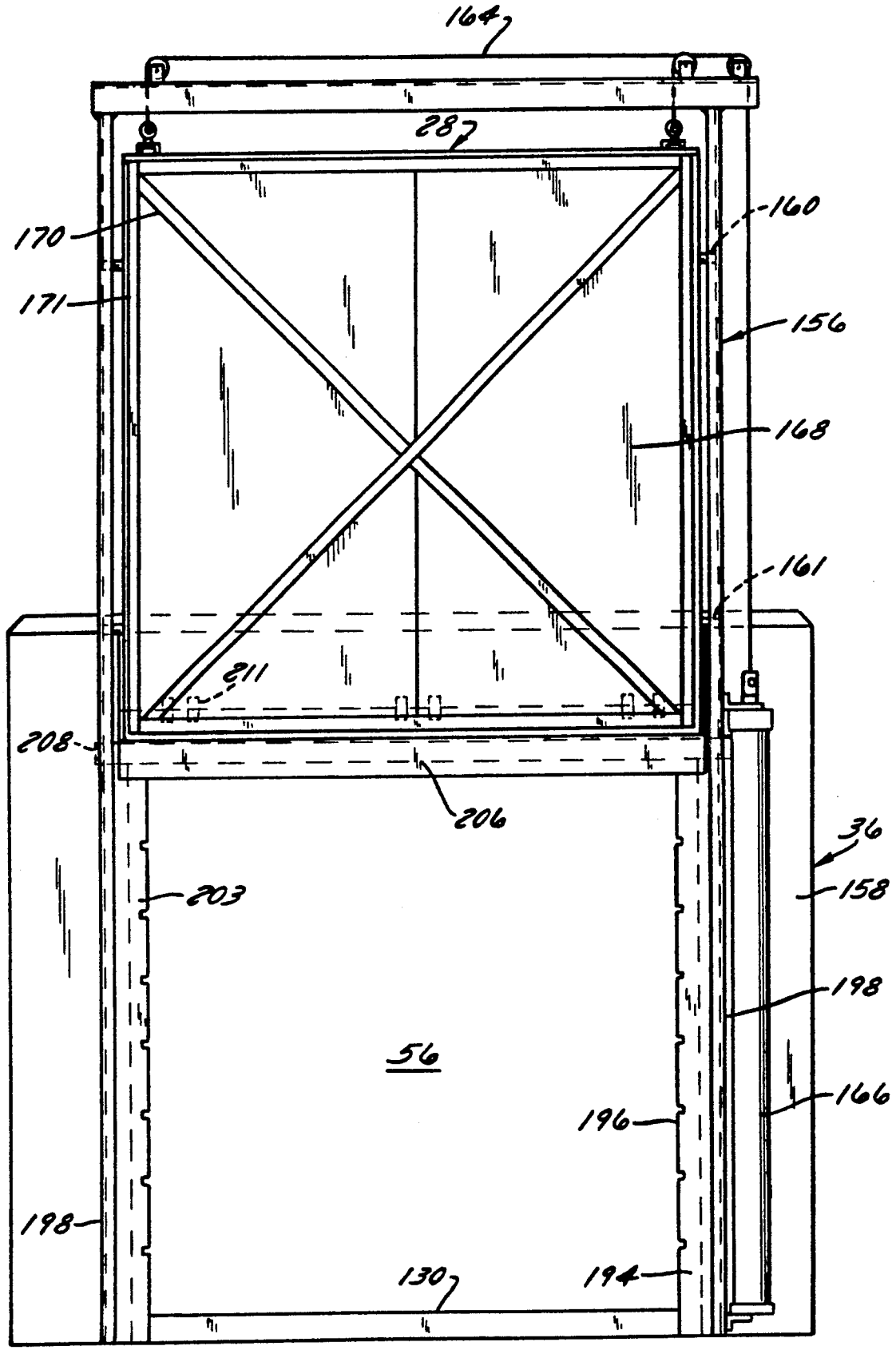
FIG. 9 is an end elevational view of a portion of the oven of FIG. 1.
Figure 9A:
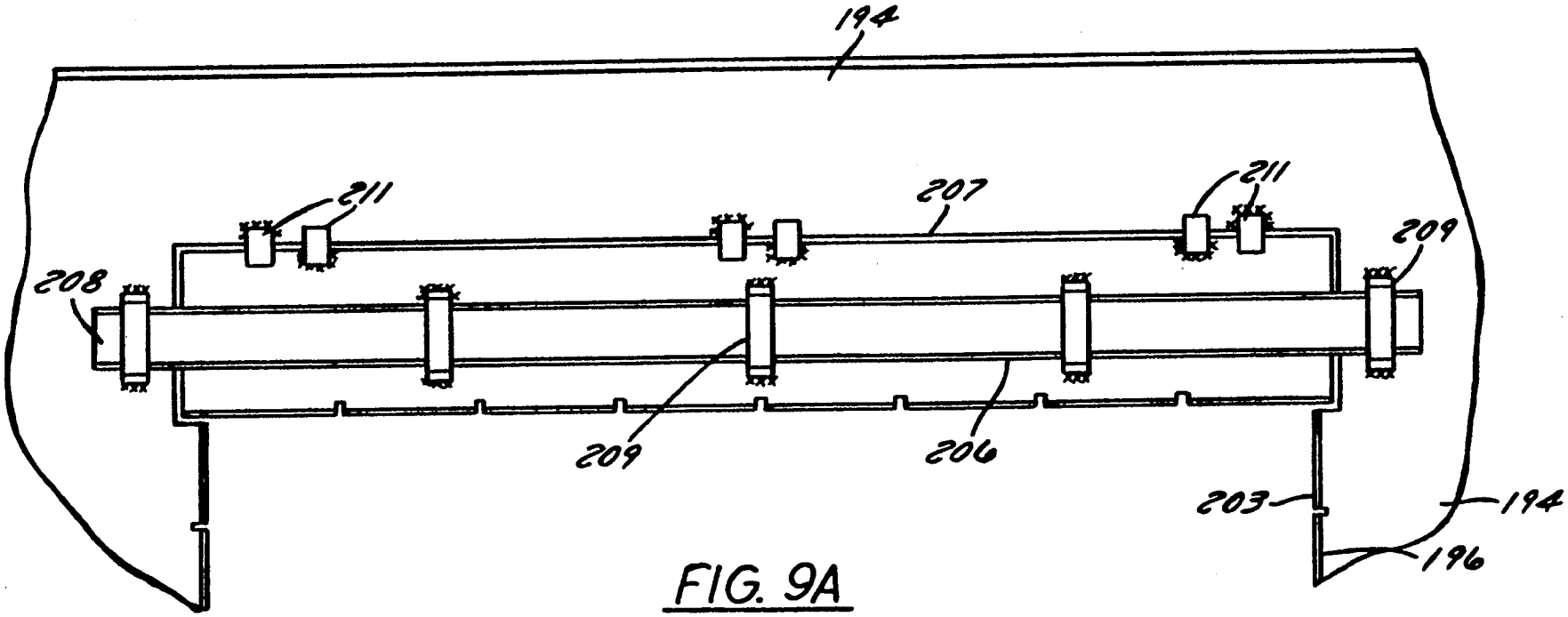
FIG. 9A is an end elevational view of a portion of the inner surface of the portion of the outer shell illustrated in FIG. 9.
Figure 10:
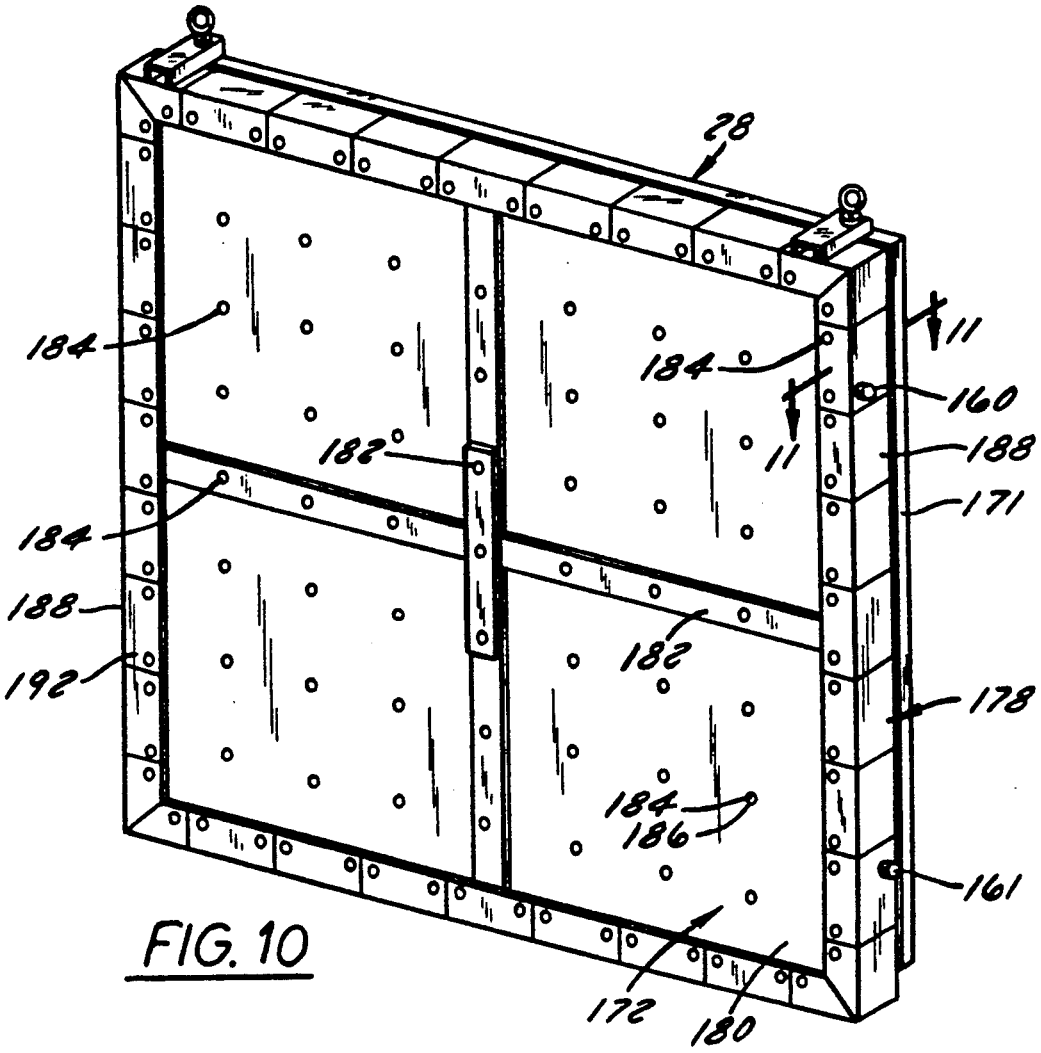
FIG. 10 is a perspective view of the inside of the door illustrated in FIGS. 8 and 9.
Figure 11:
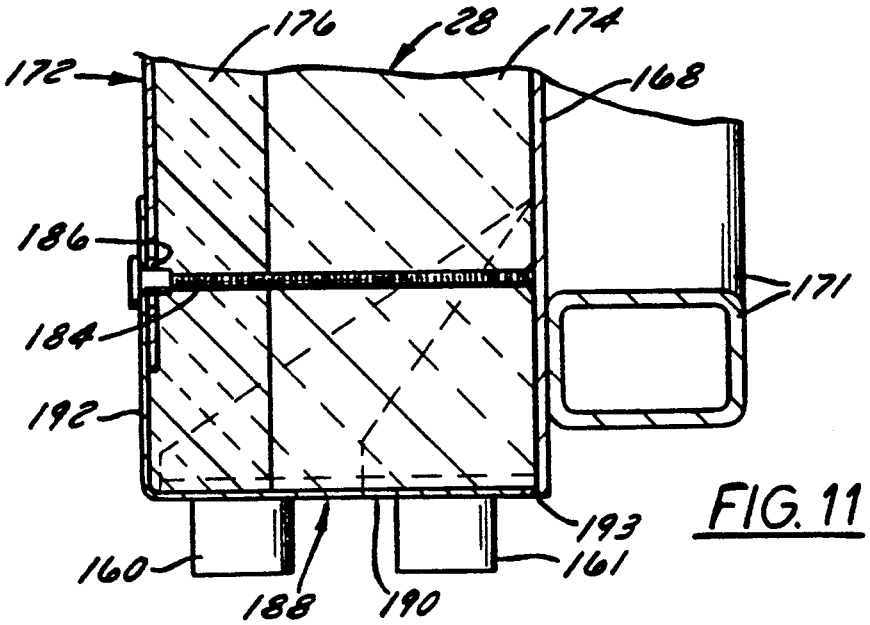
FIG. 11 is a sectional view taken along lines 11-11 of FIG. 10.
Figure 12:
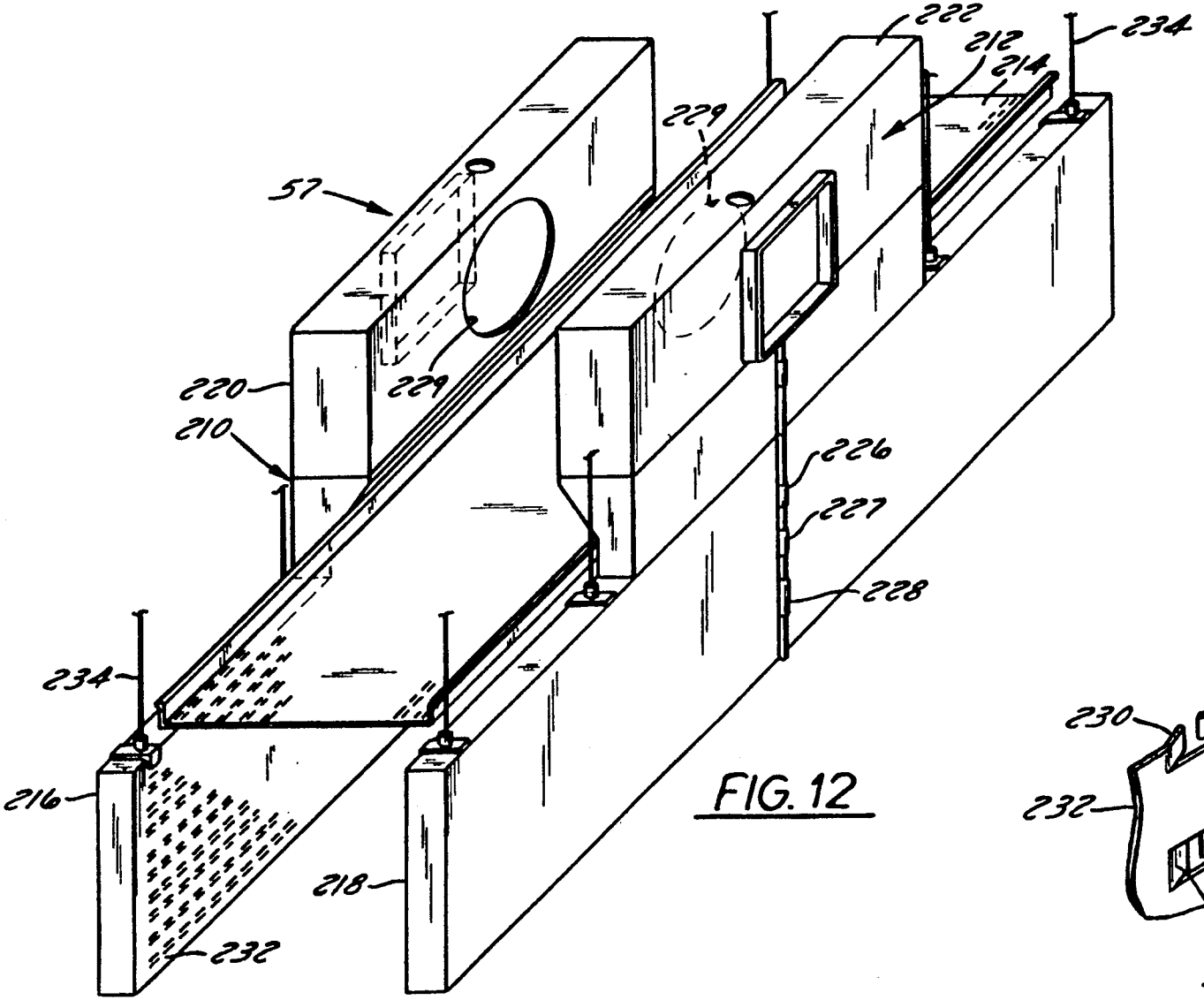
FIG. 12 is a perspective view of an air distribution system of the oven of FIG. 1.
Figure 13:
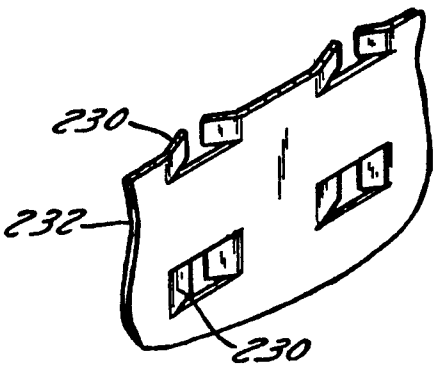
FIG. 13 is a detail view of a section of the air distribution system of FIG. 12.

Referring to FIGS. 8, 9, and 9A, doorway 196 is topped with a header including a rigid steel header plate 206. A header support beam 208 is strapped onto the inner face of the header by straps 209. The lower portion of the header plate 206 is disposed adjacent an opening of the oven and thus is exposed to temperatures significantly above the ambient temperature, thus subjecting the plate 206 to significant expansions.

Measures are taken to prevent the header plate 206 from buckling or warping as it expands. More specifically, the header plate 206 is disposed in an enlarged opening formed in surrounding frame 194 of the outer shell 76 with a seam 207 formed therebetween. Header plate 206 is attached to the frame 194 by connecting bars 211 identical in construction and operation to the connecting bars 140 connecting the plates 131–135 of the floor 130 to one another. More specifically, alternate connecting bars 211 are welded to the header plate 206 and to the surrounding frame 194. These connecting bars thus permit the header plate 206 to move or walk relative to surrounding frame 194 in the same manner that the individual plates 131–135 of the floor 130 can move or walk relative to one another. The straps 209 should also be larger than the outside diameter of the header support beam 208 to permit the support beam 208 to move with the header plate 206 relative to the straps 209 as the header plate expands. The header plate 206 can thus expand both horizontally and vertically without buckling.

Construction of Air Distribution System

The air distribution system also is subject to wide variations in temperatures and thus undergoes marked expansion when the oven is heated. To accommodate such expansion, the system is suspended from the ceiling and spaced from the surrounding walls and floor.

Referring now to FIGS. 1, 2, 3, 12 and 13, the air distribution system 57 includes first and second hot air duct assemblies 210 and 212, and a perforated false ceiling 214. The duct assemblies 210 and 212 and the ceiling 214 are formed from suitable metal sheets. The air distribution systems for the second and third heating zones 24 and 26 are of identical construction and, accordingly, will not be described in more detail.

Each of the first and second duct assemblies 210 and 212 includes a respective hot air distribution duct portion 216 and 218 extending longitudinally through the chamber 56 proximate respective side wall 48, 50 of the first section 36 of oven 20. Each of the first and second duct assemblies 210 and 212 further includes a respective air circulation portion 220 and 222 mounted on top of the respective hot air distribution duct portion 216 and 218. Each of the air circulation portions 220 and 222 of the respective duct assembly 210 and 212 is mounted proximate a respective side wall of the heater housing 42 and receives a blower 224, 225 of the respective fan assembly 64, 66.

In use, air located above false ceiling 214 is heated by the burner 60 provided in the heater housing 42 of oven section 36 and drawn into openings 229 formed in the air circulation portions 220 and 222 of duct assemblies 210 and 212 by blowers 224 and 225, and is then forced downwardly into hot air distribution duct portions 216 and 218 of duct assemblies 210 and 212. The heated air is forced through perforations 230 formed in the inner wall 232 of each of the hot air distribution duct portions 216 and 218 and into chamber 56 to heat the chamber. This air is drawn upwardly through corresponding perforations formed in false ceiling 214 and reheated by burner 60, and the process is repeated.

The first and second duct assemblies may convey air of more than 1400° F. during normal operation of the oven and thus undergo marked expansion during operation. Pursuant to the invention, measures are taken to accommodate such expansion. More specifically, expansion of the duct assemblies 210 and 212 is permitted by suspending these assemblies from the top wall 52 of the first oven section 36 by a plurality of rods 234 suspended from wall 52 by caps 238. The bottom, top, and end surfaces of each of these assemblies are spaced from the adjacent surfaces of oven section 36 by a sufficient distance to permit unobstructed expansion of the metal sheets forming the duct assemblies. The outer surfaces of the duct assemblies are connected to the oven walls only by S-clips 226–228 which are vertically aligned with one another at the longitudinal center of the outer surface of the hot air distribution duct portion 216, 218 of each of the duct assemblies 210, 212 and which prevent these duct portions from swinging towards the inside of the chamber 56. Because only a few of these clips are provided on the center of each of the air distribution duct portions, they do not interfere with expansion of the duct assemblies.

False ceiling 214 is likewise not directly connected to either of the first or second duct assemblies 210 or 212 or to the top wall of the first section 76 of the oven 20. Instead, this false ceiling 214 is suspended from top wall 52 by a plurality of hanging brackets 236. If desired, these hanging brackets can be secured to the same pins 84 securing the inner shell 82 of the oven in position.

Thus, the entire oven 20 is designed so as to accommodate expansion of internal elements of the oven and so as to accommodate temperature differentials across the cross section of the oven walls. All compensation measures are designed so as to facilitate assembly and to minimize the cost of materials and assembly.

Many modifications to the disclosed invention could be made without departing from the spirit and scope thereof. The scope of the changes and modifications encompassed by the present invention will become more apparent from a reading of the appended claims.

What is claimed is:

1. A wall for an oven having an interior chamber which is heated upon operation of said oven, said wall comprising:

(A) an outer shell;

(B) a layer of insulation disposed between said outer shell and said chamber;

(C) an inner shell including a plurality of generally planar metal plates disposed between said insulation layer and said chamber, wherein spaces are formed between all adjacent plates which permit expansion of said plates without mutual contact when said chamber is heated, and wherein each of said plates has a plurality of oversized holes formed therein; and (D) a plurality of support pins, each of which includes a first end affixed to said outer shell, an elongated shank, a second end, and a head secured to said second end, said elongated shanks extending through said insulation layer and said holes and having diameters which are significantly smaller than those of said holes so as to permit movement of said plates relative to said pins upon expansion of said plates, said heads tensioning said plates towards said insulation layer, thereby holding said plates in position.

2. A wall according to claim 1, further comprising a plurality of overlapping metal lapping strips, each of which covers at least a portion of one of said spaces and has a plurality of oversized holes formed therein, and a second plurality of support pins, each of which includes a first end affixed to said outer shell, an elongated shank, a second end, and a head attached to said second end, said elongated shanks extending through said insulation layer and said holes formed in said lapping strips and having diameters which are significantly smaller than those of said holes in said lapping strips so as to permit movement of said lapping strips relative to said pins upon expansion of said plates and said lapping strips, said heads tensioning said plates and said lapping strips towards said insulation layer, thereby holding said plates and said lapping strips in position.

3. A wall according to claim 2, wherein said plates and said lapping strips are made from one of aluminized steel and stainless steel.

4. A wall according to claim 3, wherein said holes are about 1" in diameter and said pins are about ¼" in diameter, and wherein said spaces are at least 1½ inches wide when said chamber is not heated.

5. A wall according to claim 1, wherein at least one of said plates if a 4' and 4' square plate.

6. A wall according to claim 1, wherein said layer of insulation can withstand temperatures of 1900° F. and is positioned adjacent said inner shell, and further comprising a second layer of insulation which is disposed between and in contact with said first layer of insulation and said outer shell and which can withstand temperatures of 1000° F.

* * * * *